US012349797B2

(12) United States Patent
Lewis

(10) Patent No.: US 12,349,797 B2
(45) Date of Patent: Jul. 8, 2025

(54) BEDMAKING TOOLS AND METHODS OF MAKING AND USING THE SAME

(71) Applicant: Travis R. Lewis, Valdosta, GA (US)

(72) Inventor: Travis R. Lewis, Valdosta, GA (US)

( * ) Notice: Subject to any disclaimer, the term of this patent is extended or adjusted under 35 U.S.C. 154(b) by 345 days.

(21) Appl. No.: 17/983,628

(22) Filed: Nov. 9, 2022

(65) Prior Publication Data

US 2023/0143747 A1 May 11, 2023

Related U.S. Application Data

(60) Provisional application No. 63/277,699, filed on Nov. 10, 2021.

(51) Int. Cl.
*A47C 21/02* (2006.01)

(52) U.S. Cl.
CPC ..... *A47C 21/028* (2013.01)

(58) Field of Classification Search
CPC ... A47C 21/028; A47C 20/021; A47C 21/022; A47C 21/024; A47C 21/06; A47C 21/026; A47C 27/084; A47C 27/088; A47C 31/00; A47C 21/00; A47C 21/003; A47C 27/085; A47G 9/0246; A47G 27/0487; A47G 9/04; B66F 15/00; B66F 11/00; B66F 11/042; B66F 3/22; B66F 7/065; B25B 33/00; B25B 27/0035; B25F 1/00; A61G 7/0501; Y10T 24/23; Y10T 29/53683
USPC ..... 5/488, 658, 660, 497, 659, 482, 504.1, 5/505.1; 254/104, 131, 21, 25, 113; 7/166; D8/14, 374; 126/215, 9 B; 29/239
See application file for complete search history.

(56) References Cited

U.S. PATENT DOCUMENTS

| | | | | |
|---|---|---|---|---|
| D246,345 | S | 11/1977 | Ponica | |
| D268,073 | S | 3/1983 | Schaeffer | |
| D268,804 | S | 5/1983 | Bacon | |
| D275,540 | S | 9/1984 | Barkow | |
| 4,520,518 | A | 6/1985 | Reaser | |
| 4,745,650 | A * | 5/1988 | Elliott | A47C 21/00 81/488 |
| 4,844,416 | A * | 7/1989 | Hand | B25C 11/00 254/25 |
| 4,890,345 | A * | 1/1990 | Sessa | A47C 21/028 24/72.5 |
| D326,376 | S | 5/1992 | Barfield | |
| 5,459,897 | A | 10/1995 | Wurdack | |
| 6,598,857 | B1 | 7/2003 | Hernandez et al. | |
| D493,078 | S | 7/2004 | McGee | |

(Continued)

OTHER PUBLICATIONS

PCT/US2022/049372 International Search Report and Written Opinion, Mar. 22, 2023.

*Primary Examiner* — Madison Emanski

(57) ABSTRACT

Bedmaking tools for lifting a bed mattress from a supporting surface, such as a box spring, are disclosed. The bedmaking tools have an I-beam tool body construction with (a) a front I-beam member providing a front major surface of the tool, (b) a rear I-beam member providing a bottom surface and a rear major surface of the tool, and (c) an intermediate I-beam connecting member extending between the front I-beam member and the rear I-beam member, the front I-beam member being a distance d from the rear I-beam member along an overall length of the tool body. Methods of making and using the disclosed bedmaking tools are also disclosed.

17 Claims, 12 Drawing Sheets

(56) References Cited

U.S. PATENT DOCUMENTS

| | | | | |
|---|---|---|---|---|
| D563,744 | S | 3/2008 | Adwar | |
| D655,144 | S | 3/2012 | Hajarlazdeh | |
| D660,115 | S | 5/2012 | Montross | |
| D743,761 | S | 11/2015 | Dioguardi | |
| D880,263 | S | 4/2020 | Pottorff | |
| D915,162 | S | 4/2021 | Garrett | |
| 2004/0026674 | A1* | 2/2004 | Hernandez | B66F 15/00 254/25 |
| 2010/0175195 | A1* | 7/2010 | Harris Adamson | A47C 21/028 5/659 |
| 2011/0179578 | A1* | 7/2011 | Montross | A47C 20/021 5/660 |
| 2016/0198863 | A1* | 7/2016 | Russo | A47G 9/0246 5/497 |
| 2021/0282568 | A1* | 9/2021 | Garrett | A47C 21/028 |

* cited by examiner

BEDMAKING TOOLS AND METHODS OF MAKING AND USING THE SAME

CROSS-REFERENCE TO RELATED APPLICATIONS

This patent application claims the benefit of priority to U.S. Provisional Patent Application Ser. No. 63/277,699 filed on Nov. 10, 2021 entitled "BEDMAKING TOOLS AND METHODS OF MAKING AND USING THE SAME," the subject matter of which is hereby incorporated by reference in its entirety.

FIELD OF THE INVENTION

This invention relates to bed-making tools, and the use of bedmaking tools to make a bed.

BACKGROUND

Bed mattresses are cumbersome to work with, heavy, awkward, and many times a source for potential back strain and other injury. Some people are not physically capable of moving and maneuvering bed mattresses due to their size and weight.

There is a need in the art for tools that can assist a person moving and/or maneuvering a bed mattress.

SUMMARY OF THE INVENTION

The present invention is directed to bed-making tools. In some embodiments of the present invention, the bedmaking tool comprises: a tool body having an overall height $H_o$, an overall width $W_o$, an overall thickness $T_o$, and an overall length $L_o$, said tool body comprising (a) a wedge portion comprising a tool front edge (or nose) at a first end, (b) a tool handle (or cantilever arm) at a second end opposite said first end, (c) a heel positioned between said wedge portion and said tool handle, said heel comprising a heel surface portion having an arc of curvature thereon, and representing a portion of a rear major surface of said bedmaking tool, (d) a front major surface extending from said tool front edge towards said second end, (e) a bottom surface extending from said tool front edge to said heel surface portion, and (f) said rear major surface extending from said heel surface portion towards the second end, wherein (1) said overall length $L_o$ comprises a distance from said first end to said second end along said bottom surface and said rear major surface, and (2) said front major surface forms (i) a first acute angle A with said bottom surface along said wedge portion of said tool body, and (ii) a second acute angle B with said bottom surface along said tool handle of said tool body.

In some embodiments of the present invention, the bedmaking tool comprises: a tool body having an overall height $H_o$, an overall width $W_o$, an overall thickness $T_o$, and an overall length $L_o$, said tool body comprising (a) a wedge portion comprising a tool front edge (or nose) at a first end, (b) a tool handle (or cantilever arm) at a second end opposite said first end, (c) a heel positioned between said wedge portion and said tool handle, said heel comprising a heel surface portion having an arc of curvature thereon, and representing a portion of a rear major surface of said bedmaking tool, (d) a front major surface extending from said tool front edge towards said second end, (e) a bottom surface extending from said tool front edge to said heel surface portion, and (f) said rear major surface extending from said heel surface portion towards the second end, wherein (1) said overall length $L_o$ comprises a distance from said first end to said second end along said bottom surface and said rear major surface, and (2) said tool body comprises an I-beam type construction comprising (a) a front I-beam member providing said front major surface, (b) a rear I-beam member providing said bottom surface and said rear major surface, and (c) an intermediate I-beam connecting member extending between said front I-beam member and said rear I-beam member, said front I-beam member being a distance d from said rear I-beam member along said overall length $L_o$ of said tool body.

In some embodiments of the present invention, the bedmaking tool comprises: a tool body having an overall height $H_o$, an overall width $W_o$, an overall thickness $T_o$, and an overall length $L_o$, said tool body comprising (a) a wedge portion comprising a tool front edge (or nose) at a first end, (b) a tool handle (or cantilever arm) at a second end opposite said first end, (c) a heel positioned between said wedge portion and said tool handle, said heel comprising a heel surface portion having an arc of curvature thereon, and representing a portion of a rear major surface of said bedmaking tool, (d) a front major surface extending from said tool front edge towards said second end, (e) a bottom surface extending from said tool front edge to said heel surface portion, and (f) said rear major surface extending from said heel surface portion towards the second end, wherein (1) said overall length $L_o$ comprises a distance from said first end to said second end along said bottom surface and said rear major surface, and (2) said front major surface comprises (i) a substantially flat portion extending from said tool front edge, (ii) a first concave curvature portion extending from said substantially flat portion towards said second end, and (iii) a first convex curvature portion extending between said first concave curvature portion and said second end.

In some embodiments of the present invention, the bedmaking tool comprises: a tool body having an overall height $H_o$, an overall width $W_o$, an overall thickness $T_o$, and an overall length $L_o$, said tool body comprising (a) a wedge portion comprising a tool front edge (or nose) at a first end, (b) a tool handle (or cantilever arm) at a second end opposite said first end, (c) a heel positioned between said wedge portion and said tool handle, said heel comprising a heel surface portion having an arc of curvature thereon, and representing a portion of a rear major surface of said bedmaking tool, (d) a front major surface extending from said tool front edge towards said second end, (e) a bottom surface extending from said tool front edge to said heel surface portion, and (f) said rear major surface extending from said heel surface portion towards the second end, wherein (1) said overall length $L_o$ comprises a distance from said first end to said second end along said bottom surface and said rear major surface, and (2) said front major surface comprises (i) a substantially flat portion extending from said tool front edge, (ii) a first concave curvature portion extending from said substantially flat portion towards said second end, (iii) a first convex curvature portion extending between said first concave curvature portion and said second end, and (iv) a second concave curvature portion extending between said first convex curvature portion and said second end.

The present invention is also directed to methods of making bed-making tools. In some embodiments of the present invention, the method of making a bed-making tool comprises: forming a tool body having an overall height $H_o$, an overall width $W_o$, an overall thickness $T_o$, and an overall length $L_o$, the tool body comprising (a) a wedge portion comprising a tool front edge (or nose) at a first end, (b) a tool handle (or cantilever arm) at a second end opposite the first end, (c) a heel positioned between the wedge portion and the tool handle, the heel comprising a heel surface portion having an arc of curvature thereon, and representing a portion of a rear major surface of the bedmaking tool, (d) a front major surface extending from the tool front edge towards the second end, (e) a bottom surface extending from the tool front edge to the heel surface portion, and (f) the rear major surface extending from the heel surface portion towards the second end, wherein the overall length $L_o$ comprises a distance from the first end to the second end along the bottom surface and the rear major surface, said forming step comprising at least one of: a thermoforming step, a machining step, a molding step, and an extrusion step.

The present invention is further directed to methods of using bed-making tools. In some embodiments of the present invention, the method of using a bed-making tool comprises: inserting a wedge portion comprising a tool front edge (or nose) at a first end of the bed-making tool between a mattress and a box spring; and at least one of: positioning a sheet between the mattress and the box spring using the wedge portion of the bed-making tool, lifting the mattress by pushing down on a tool handle (or cantilever arm) of the bed-making tool, and moving the mattress relative to the box spring using the bed-making tool.

These and other features and advantages of the present invention will become apparent after a review of the following detailed description of the disclosed embodiments and the appended claims.

BRIEF DESCRIPTION OF THE DRAWINGS

The present invention is further described with reference to the appended figures, wherein.

The features of the present bed-making tool and methods are set forth in part in the following preferred embodiments. This overview is intended to provide nonlimiting descriptions of the present subject matter and is not intended to provide an exclusive or exhaustive explanation. The preferred embodiments below provide further information about the bed-making tools and methods of the present invention as described herein.

DETAILED DESCRIPTION OF THE INVENTION

The present invention relates to bedmaking tools. The bedmaking tools can be used to assist someone in dressing, making, moving, handling, and/or preparing a bed that utilizes industry standard mattresses, such as a mattress with box springs. Exemplary bedmaking tools are shown, for example, in FIGS. 1 and 5.

Figure 1:
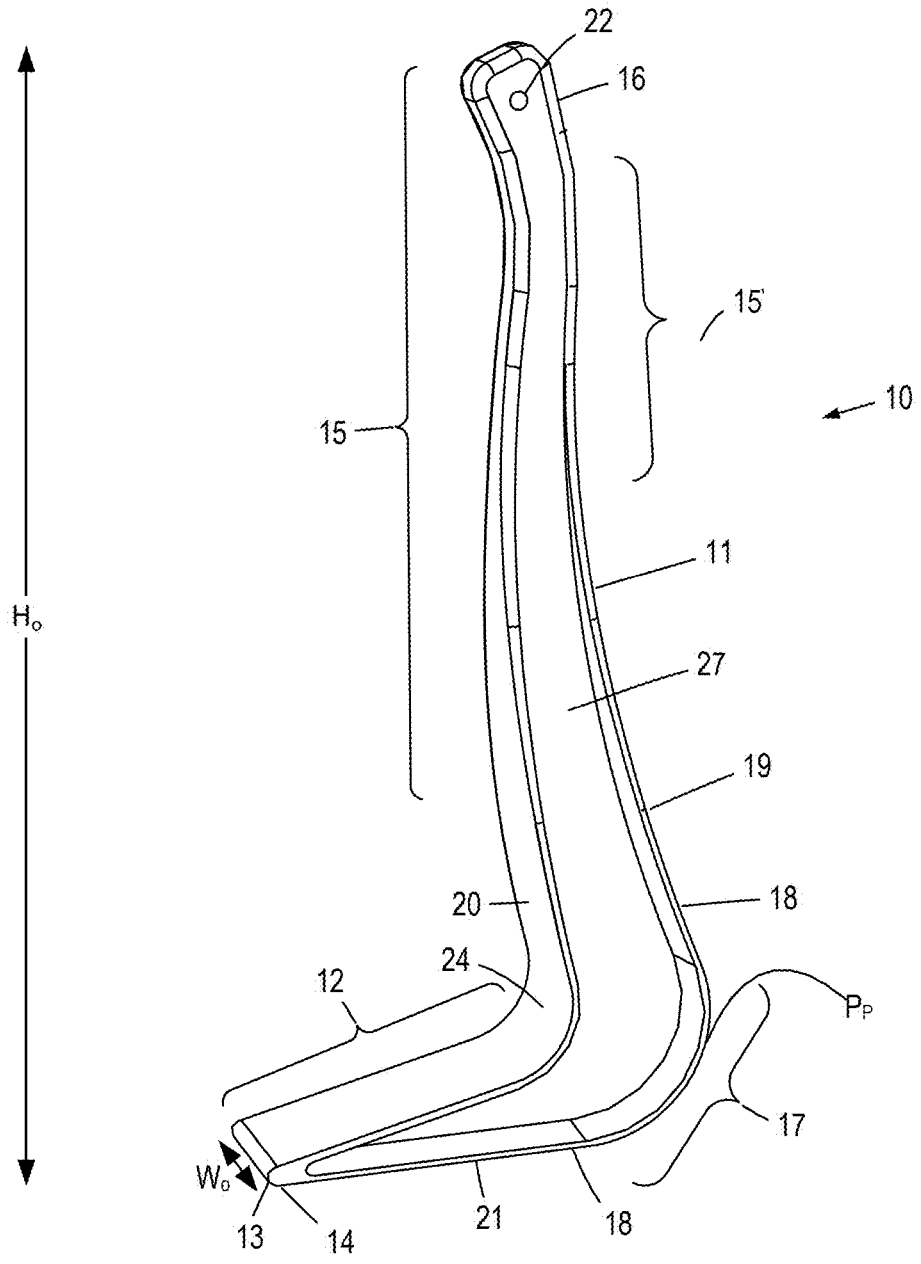
FIG. 1 is a perspective view of an exemplary bed-making tool of the present invention.
Figure 2:
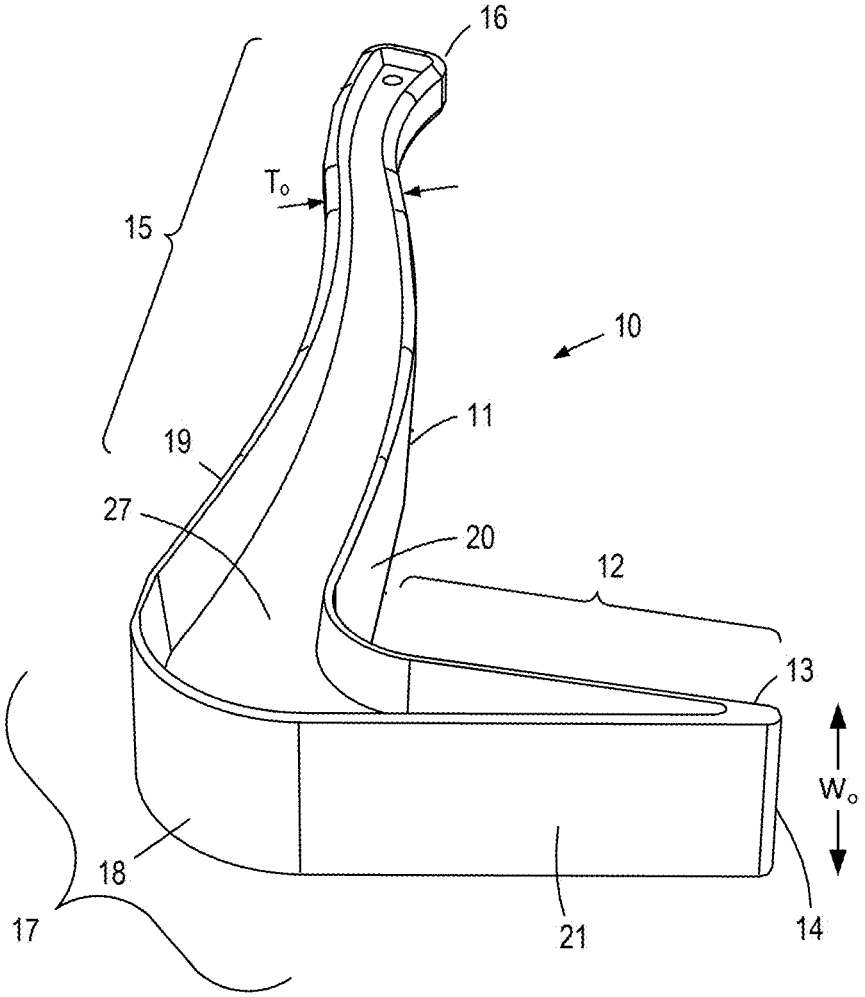
FIG. 2 is another perspective view of the exemplary bed-making tool shown in FIG. 1 as viewed from a lower side of the exemplary bed-making tool shown in FIG. 1.
Figure 3:
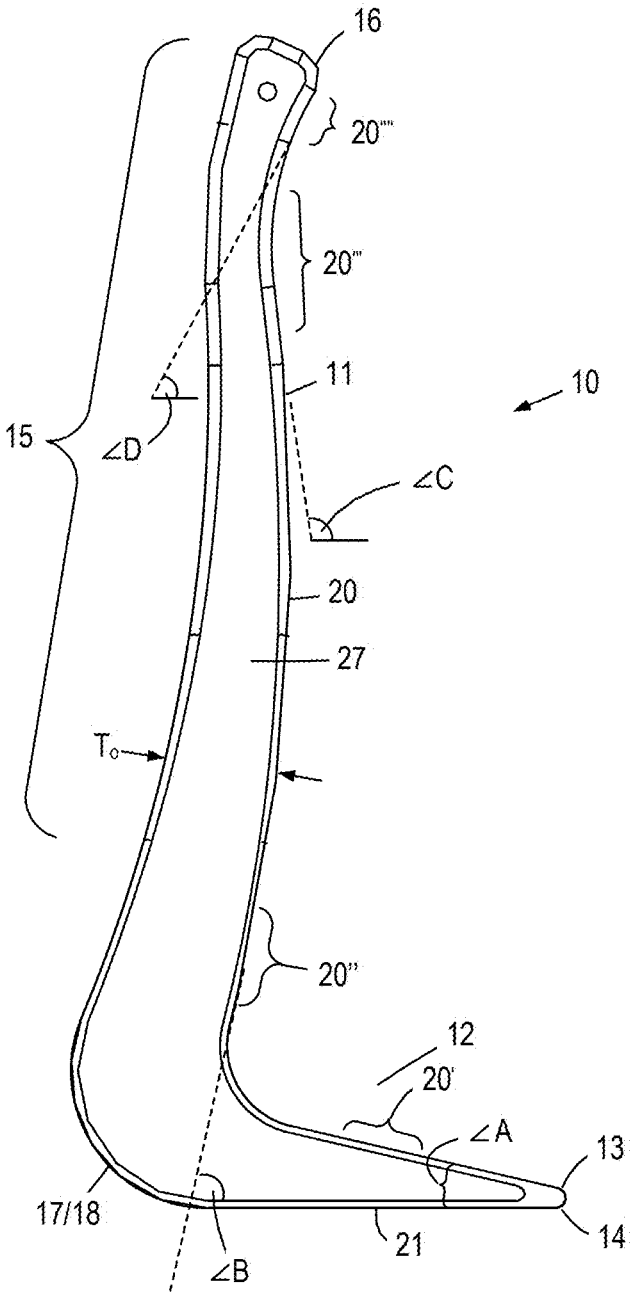
FIG. 3 is a left-side view of the exemplary bed-making tool shown in FIG. 1.

As shown in FIGS. 1-3, exemplary bedmaking tool 10 comprises: a tool body 11 having an overall height $H_o$, an overall width $W_o$, and an overall thickness $T_o$. Exemplary tool body 11 comprises (a) a wedge portion 12 comprising a tool front edge 13 (also referred to herein as nose 13) at a first end 14, (b) a tool handle 15 ((also referred to herein as cantilever arm 15) at a second end 16 opposite the first end 14, and (c) a heel 17 positioned between the wedge portion 12 and the tool handle 15, wherein the heel 17 (i) comprises a heel surface portion 18 having an arc of curvature thereon, and (ii) represents a portion of a rear major surface 19 of the bedmaking tool 10. The tool body 11 further comprises (d) a front major surface 20 extending from the tool front edge 13 towards the second end 16, (e) a bottom surface 21 extending from the tool front edge 13 to the heel surface portion 18, and (f) the rear major surface 19 extending from the heel surface portion 18 towards the second end 16, wherein the front major surface 20 forms (i) a first acute angle A with the bottom surface 21 along the wedge portion 12 of the tool body 11 (see, for example, FIG. 3), and (ii) a second acute angle B with the bottom surface 21 along the tool handle 15 of the tool body 11 (see again, for example, FIG. 3).

Figure 5:
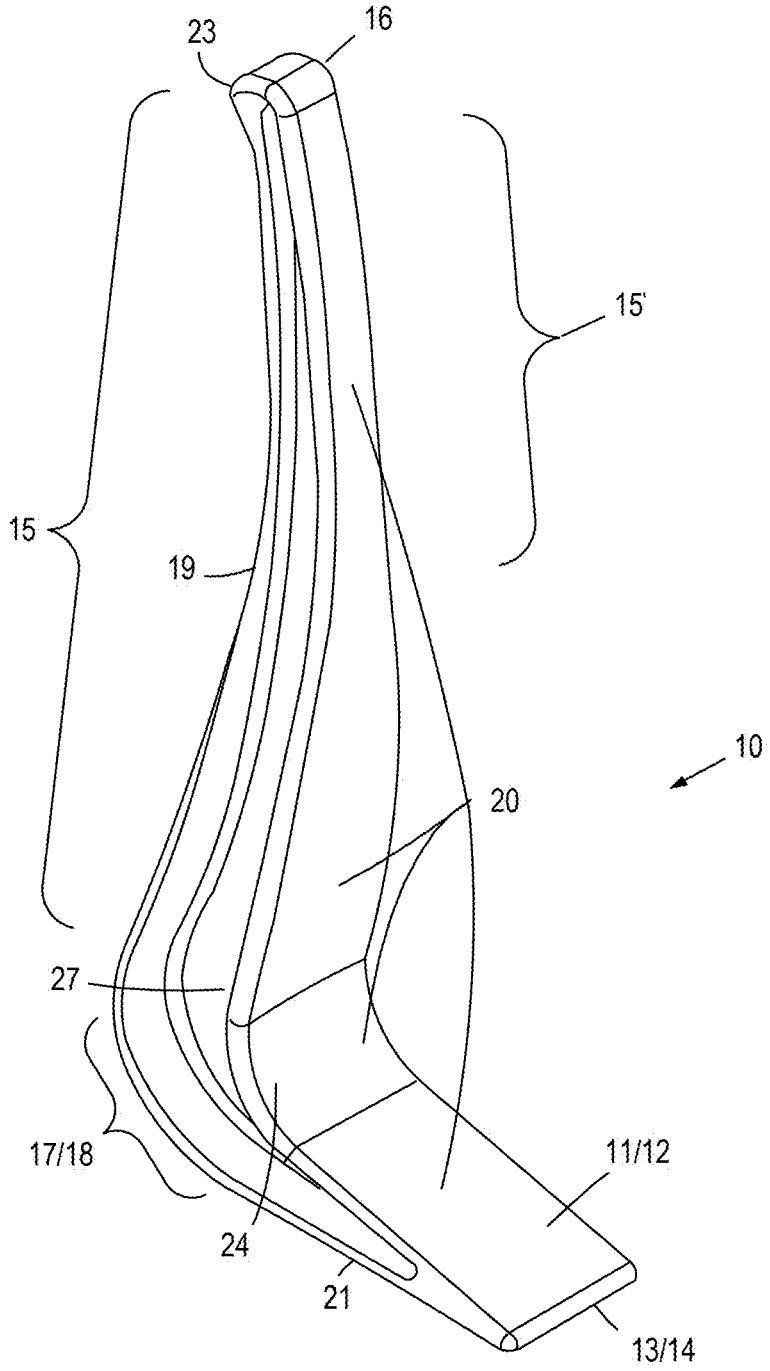
FIG. 5 is a perspective view of another exemplary bed-making tool of the present invention.
Figure 6:
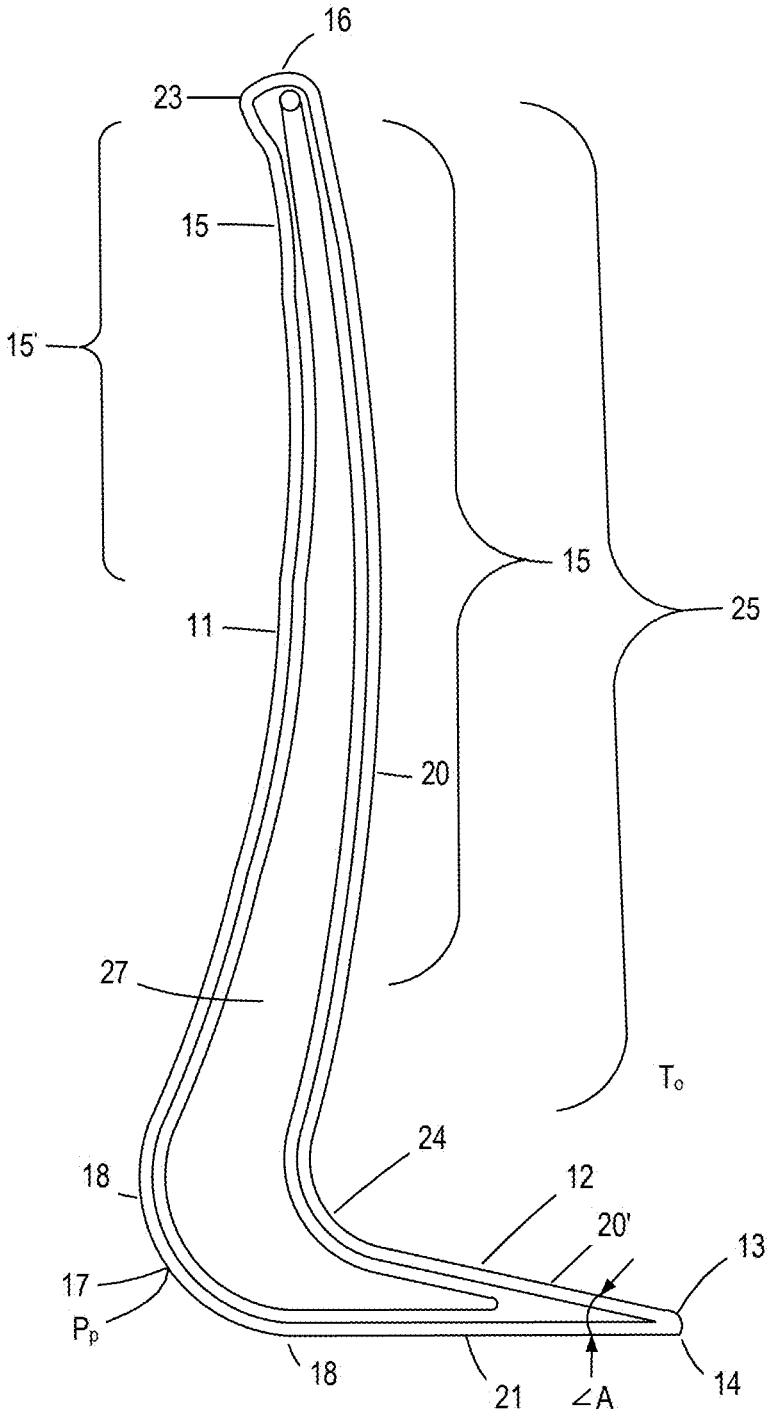
FIG. 6 is a left-side view of the exemplary bed-making tool shown in FIG. 5.
Figure 7:
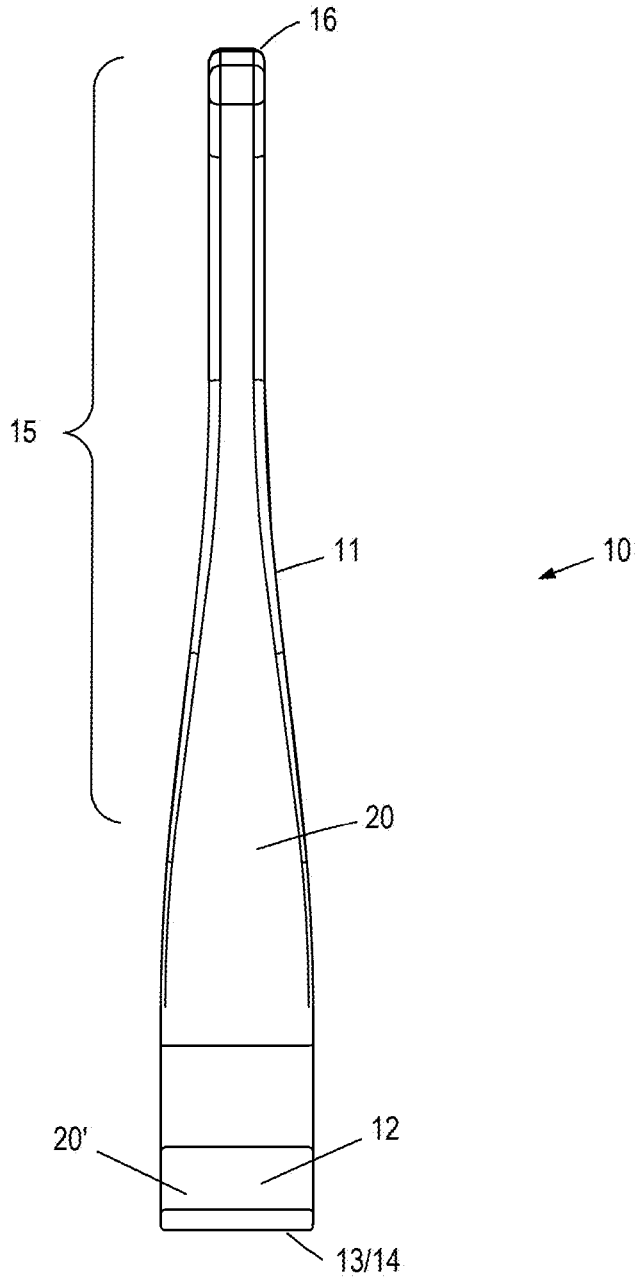
FIG. 7 is a front view of the exemplary bed-making tool shown in FIG. 5.

Another exemplary bedmaking tool 10 is shown in FIGS. 5-7. In this embodiment, exemplary bedmaking tool 10 also comprises: a tool body 11 having an overall height $H_o$, an overall width $W_o$, an overall thickness $T_o$, and the other features discussed above. In this embodiment, the front major surface 20 again forms (i) a first acute angle A with the bottom surface 21 along the wedge portion 12 of the tool body 11 (see, for example, FIG. 6), and (ii) a second acute angle B with the bottom surface 21 along the tool handle 15 of the tool body 11 (see again, for example, FIG. 6).

As shown in FIGS. 1-4, 5-7, and 9-14, the bedmaking tool 10 may include a cantilever arm 15 with a progressively curved fixed angled wedge portion 12. Along the rear major surface 19 of the bedmaking tool 10 is a concave curvature, which provides clearance for the tool 10 to lock a mattress 50 into place once engaged. The tool handle portion 15 of the cantilever arm 15 provides a non-slip grip for operational use, and may comprise a hole 22 where a cord (not shown) could be inserted to allow for hanging and storing.

The designed profile of the bedmaking tools 10 provides a number of advantages. The bedmaking tools 10 may comprise a solid profile, a hollow shell profile, or as shown in the figures, an "I-Beam" like cavity appearance, which provides manufacturing advantages and efficiencies, as well as structural and mechanical advantages over some other methods. For example, by manufacturing with cavities, the method provides injection molding advantages for releasing from molds as well as better control over wall thicknesses, and structural integrities.

As discussed herein, the present invention is directed to a cosmetically, visually pleasing home utility bedmaking tool 10 that assists a user in various aspects of making a bed and maneuvering a mattress. The bedmaking tool 10 of the present invention provides at least the following ways of helping with a mattress:

1. Handling of a Mattress

Method steps of shifting, lifting, and prying are necessary to make the chore of working with a mattress more manageable and less of a safety risk. For example, the step of aligning a mattress with its matching box spring underneath requires, at a minimum, shifting the mattress, and in some cases lifting the mattress. In addition, mattress makers prefer that a mattress be rotated and flipped often to prevent wear, settlement, and fatigue in the engineered materials of the mattress, and to refresh the mattress and provide a better sleeping experience for the user.

Many users find it difficult to initiate these endeavors due to the low height of the mattress to the ground, its proximity to the box spring, and the distance required to get underneath the mattress to initiate a better lift angle. To assist in these endeavors and potentially prevent further back strain, the bedmaking tools 10 of the present invention provide the ability to shift a bed mattress more easily (i.e., as shown, for example, in FIG. 9), and at least partially lift the mattress (i.e., as shown, for example, in FIGS. 10-11). It also provides enough lift (IMAGE 5) to allow a user to get underneath the mattress and get a better strong hold when rotating out and/or attempting to flip a mattress (see, again, FIG. 10).

2. Installation of Fitted Sheets

Making a bed (i.e., working with sheets) and putting fitted sheets on mattresses (see FIG. 8) can be a source of frustration and prove to be difficult to nearly impossible if the sheets that are being installed are not sized correctly for the mattress that is being dressed. Consumer purchased sheets do not always hold to the same tolerance guidelines (nor do mattress makers), and so there is an obvious opportunity for variance and installation ease or difficulty. With various methods of designing a mattress to provide market advantages, as well as the result of engineered intent, mattress thicknesses often widely vary. This alone results in most sheeting to fit differently between beds. However, even if a sheet fits correctly, working with a mattress and fitted sheets still present challenges. Some of the challenges to consider, regardless of whether the sheet is a proper fit or not, are as follows:

a. there may be external objects and items in the way of the corner or side of the mattress, which proves to make the chore difficult to complete;
b. headboards, as well as footboards, may be tight to a mattress and may prove difficult to work within;
c. mattress may be too heavy to maneuver for the person whether it be due to age, injury, physical limitations, or any combination thereof; and
d. the experience of pulling even correctly fitted sheets over the mattress can be made even easier.

In order to solve this issue, a user must get the corner (often last corner) of the fitted sheet over their mattress and hope that they have done a good enough job so that it does not release from the corner once the person gets into the bed. The disclosed bedmaking tools 10 solve this problem by allowing the user to lift and lock up a corner (see FIG. 12) of the mattress and shortening the corner-to-corner distance (036) (see FIG. 8), allowing for further reach of the fitted sheet to the mattress. If the mattress diagonal corner to diagonal corner distance is X when it is in a flat state (037), by lifting and bending a corner with the tool, it naturally brings the corner to a shorter distance<X (036). By doing this, it allows more fitted sheeting material to reach further into the mattress and creates a more accessible (due to it being raised to a more manageable height and away from interferences) and attainable environment for a successful sheet installation. The device locks the mattress up, freeing the hands to work with the sheets. As shown in the illustration the moment occurs at (024 & 025), caused by the force of mattress weight (027) (see FIG. 10).

3. Adjusting Bed Skirting

In the same way that the bedmaking tool lifts a mattress corner, making it more accessible, the bedmaking tool can also be installed and used in the middle of a mattress, allowing the user to lift the entire side of the mattress to work with and adjust decorative bed skirting. It is often difficult, as stated above, to work with the weight of a mattress. Often with bed skirting, lifting is required in order to make proper adjustments for a good cosmetically appealing dress. The bedmaking tools of the present invention provide an accessible way to pry or even lift and lock up the mattress to provide access to the open edge of the bed. As mentioned before, the bedmaking tool locks the mattress up (i.e., in a lifted position as shown, for example, in FIGS. 10-11), freeing the user's hands to work with the bed skirting.

4. Adjustment of Sheet Tensioners

Various tension bands are used in the industry to help hold corners of fitted sheets. When using these tension bands, it is cumbersome to work with and adjust to get the correct positioning and tension adjusted without having to maneuver and lift and adjust the mattress (i.e., in a similar manner when lifting the corner of the mattress to install a fitted sheet). One can use the bedmaking tool of the present invention to lift each corner of the mattress and install sheet tensioners. The bedmaking tool of the present invention makes relatively easy work for adjusting and installing fitted sheet corners with these tension bands. Allowing for an "under the hood" approach to working with adjustments and correcting.

5. Tucking the Perimeter of the Bed Sheets

For those who suffer from back injuries or choose to be preventative in these matters, there are further challenges in tucking the hanging tail of the loose bed sheet and the fitted sheet into the perimeter of the bed. This requires one to bend over, putting undue strain on one's back and working the sheets between the mattress and the box spring, tucking in the perimeter tail of these sheets. Often it is required that one has to lift the mattress to get the sheet neatly tucked between the two. With the bedmaking tool of the present invention, a user can do this while still standing upright.

6. Quick Flipping the Corners

Figure 13:
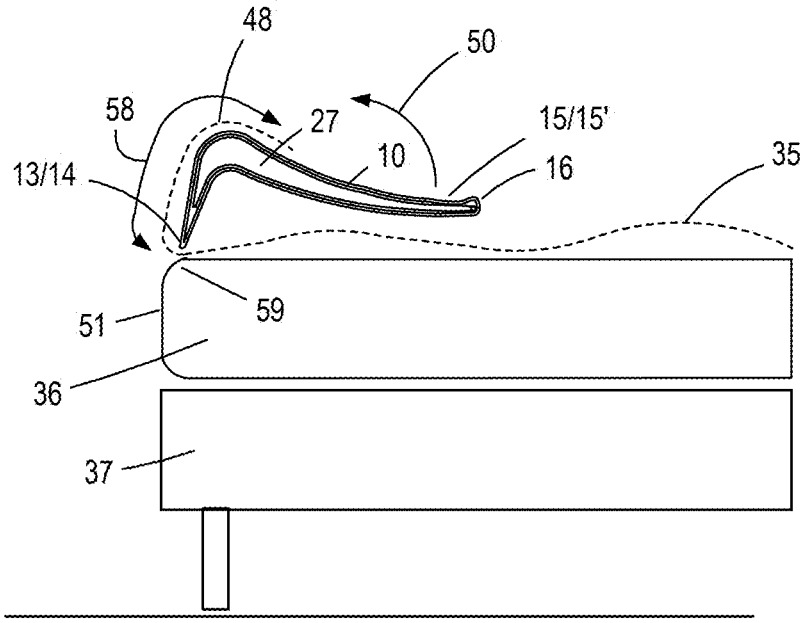
FIG. 13 is a side view of the exemplary bed-making tool shown in FIG. 5 in a use position with a front edge of the exemplary bed-making tool guiding a sheet along an upper surface of a mattress.
Figure 14:
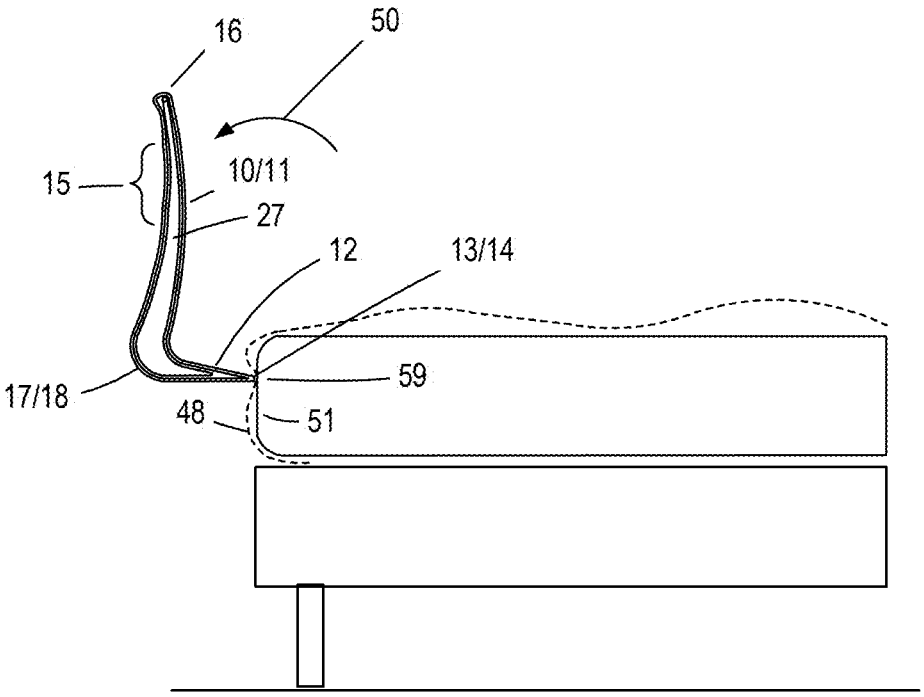
FIG. 14 is a side view of the exemplary bed-making tool shown in FIG. 5 in a use position with a front edge of the exemplary bed-making tool guiding a sheet along a side surface of a mattress and under the mattress.

The bedmaking tools 10 of the present invention enable a quick installation method for getting tight fitted sheets over the corner of a bed mattress either to quickly make a bed or the initial step of getting extremely tight sheets over the mattress to then be lifted and then adjusted with the corner lift method. The bedmaking tool 10 of the present invention provides a quick and leveraged way of working with an aggravating tight corner and flipping the sheet over the edge of this corner as shown in FIGS. 13-14.

The bedmaking tools 10 of the present invention may further comprise one or more of the features shown in FIGS. 1-14, and described below.

Figure 10:
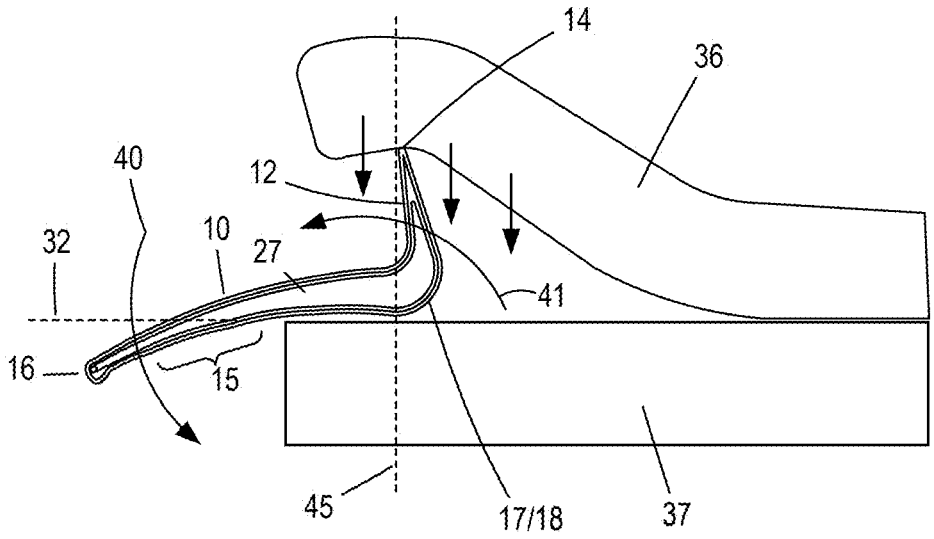
FIG. 10 is a side view of the exemplary bed-making tool shown in FIG. 5 in a use position with a lower portion of the exemplary bed-making tool under and lifting a mattress.
Figure 11:
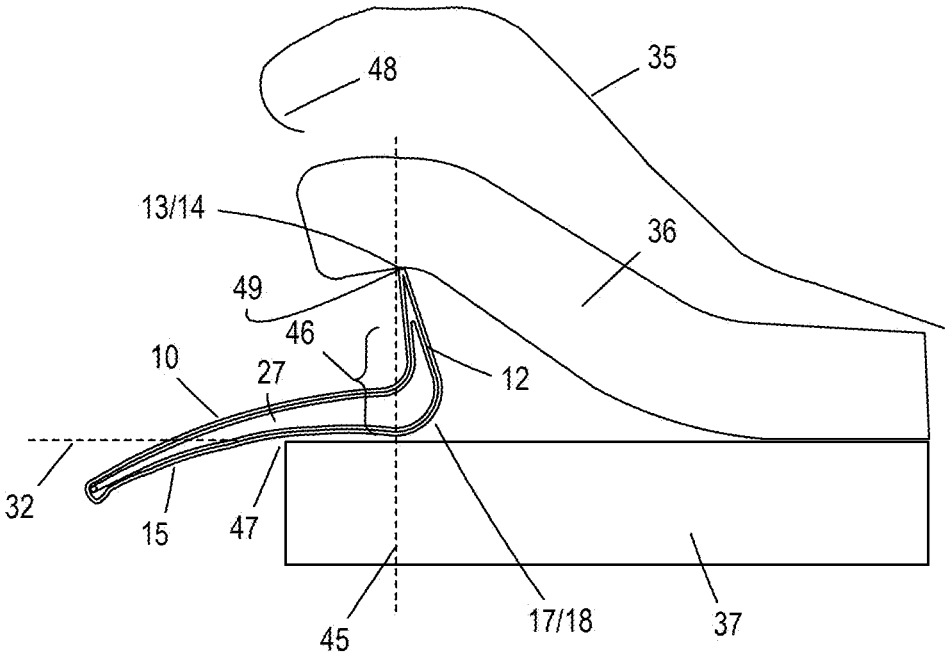
FIG. 11 is a side view of the exemplary bed-making tool shown in FIG. 5 in a use position with a lower portion of the exemplary bed-making tool under and lifting a mattress, and a sheet positioned over the mattress.

- eye 22 for hanging bedmaking tool 10 on, for example, a nail head;
- a handle butt 23 for reducing the tendency for the users' hand to slip;
- the ability to stand upright and not fall over when left on a floor (or another flat surface);
- a gripping portion 15' along the tool handle 15;
- a rear surface 19 having a locking curvature that allows the tool 10 to past below a horizontal plane 32 as shown in FIGS. 10-11;
- heel 17 that provides a pivot radius upon which the levering action rolls and pivots. This heel rolls on the box spring and allows the mattress to be moved upward by a cam-like action. It's radius size, for example, of about 2.0 inches (in) or greater, makes for a gradual transition for smooth rotation.
- tool may, for example, have an overall height $H_o$ of about 20 in, which allows for proper leverage;
- the distance from (i) a pivot point on the heel 17 and (ii) a point where the user's hand holds tool handle 15 provides leverage so the weight of the mattress 36 is reduced;
- a first angle A of about 15°, which enables the tool 10 to (i) easily slide in between mattress 36 and box spring 37, (ii) start the mattress 36 lifting sequence, and (iii) tightly tuck a sheet 35 in between the mattress 36 and box spring 37;
- a front edge or nose 13 of wedge portion 12 is sized and designed to (i) be inserted in between the mattress 36 and box spring 37, (ii) support a mattress 36 once locked upward, (iii) not be too sharp of an edge (i.e., to puncture or cut a sheet 35 or mattress 36), but still have enough edge to perform a suitable sheet tucking function;
- a front edge or nose 13 of wedge portion 12 having a nose radius of about 3/16 in; and
- a "stop" location 24 along wedge portion 12 for the tucking of the wedge portion 12 under a mattress 36.

The bedmaking tools 10 of the present invention may be used in one or more steps as shown in FIGS. 8-14, and described below.

Figure 9:
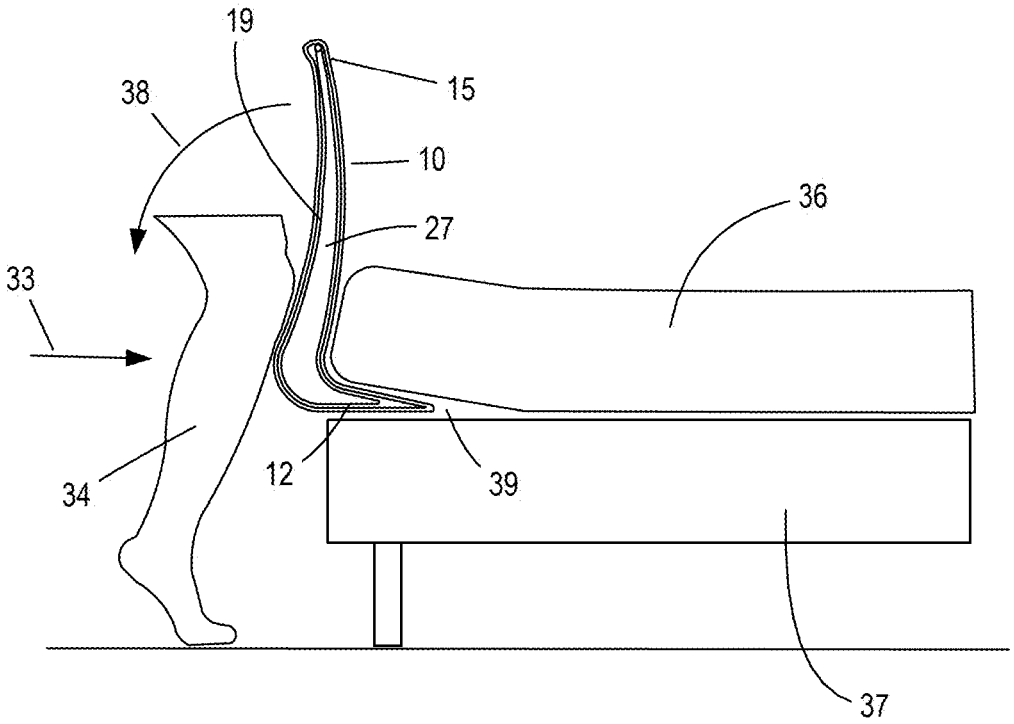
FIG. 9 is a side view of the exemplary bed-making tool shown in FIG. 5 in a use position with a front edge of the exemplary bed-making tool under a mattress.
Figure 12:
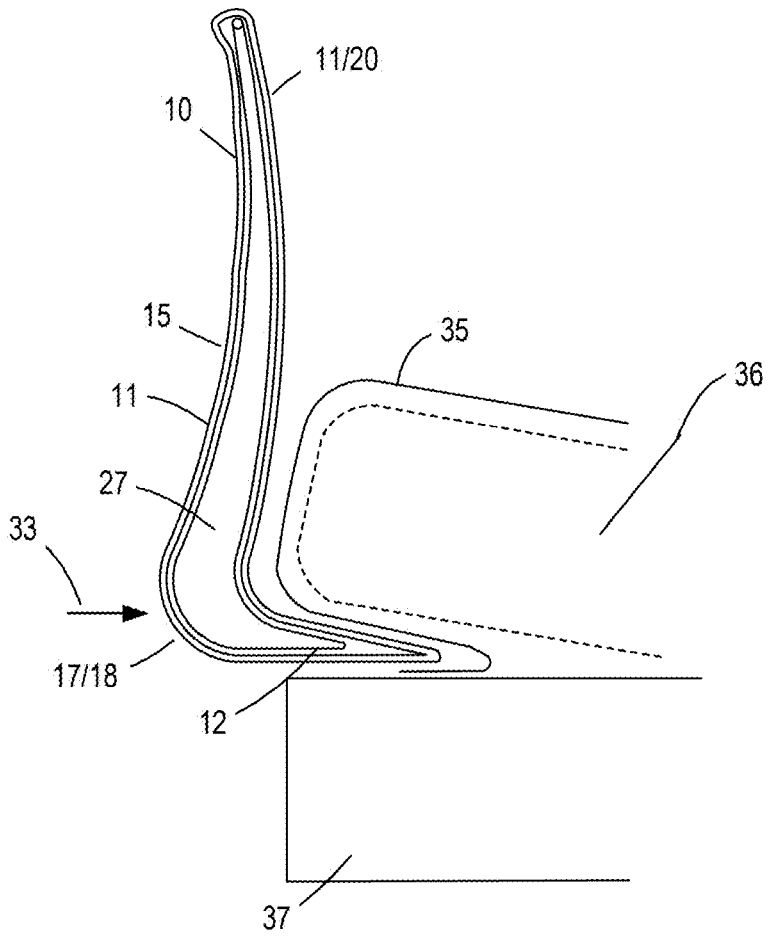
FIG. 12 is a side view of the exemplary bed-making tool shown in FIG. 5 in a use position with a sheet portion extending under the mattress between the mattress and a lower portion of the exemplary bed-making tool.

Tucking Function arrow 33 shown in FIGS. 9 and 12 shows the driving force performed by a user's knee or leg 34 during the tucking of sheet 35 under mattress 36 (i.e., between mattress 36 and box spring 37);

wedge portion 12 has a length that enables (i) penetration between the mattress 36 and box spring 37, and (ii) pushing of excess sheet 35 under the mattress 36;

pushing the tool 10 up to shoulder 24 along wedge portion 12 provides enough length to perform an efficient "tuck" and creates a stopping point 11 for mattress 36 along tool 10.

Insertion of the Tool for Tucking and Initial Lifting Steps

- arrow 38 shown in FIG. 9 shows a pull direction of the handle 15 once the tool 10 has been properly inserted to stopping point 11 for mattress 36 along tool 10 to (i) start a mattress 36 lift, or to be used for shifting the mattress 36;
- arrow 33 shown in FIGS. 9 and 12 shows the driving force performed by a user's knee or leg 34 during the tucking of sheet 35 under mattress 36 (i.e., between mattress 36 and box spring 37);
- wedged space 39 shown in FIG. 9 is created by tool 10, and represents the location where tucking takes place;
- for lifting, lever force shown arrow 38 is included to lift the mattress 36 with the tool 10.

Lifting Rotation Moment

- arrow 40 shown in FIG. 10 shows the motion that lifts mattress 36, using the radiused heel 17 as a rolling pivot;
- arrow 41 shown in FIG. 10 shows the counter-moment in which the weight of the mattress 36 exerts down and causes the tool handle 15 to push down into the box spring 37, "locking" the tool 10 into place and keeps the mattress 36 up;
- in some embodiments, a distance $D_P$ from (i) the front edge or nose 13 of wedge portion 12 to (ii) a pivot point $p_P$ along a portion of rear major surface 19 along heel 17 is approximately 9.0 in;

Other Details of Operation Shown in the Figures

Figure 8:
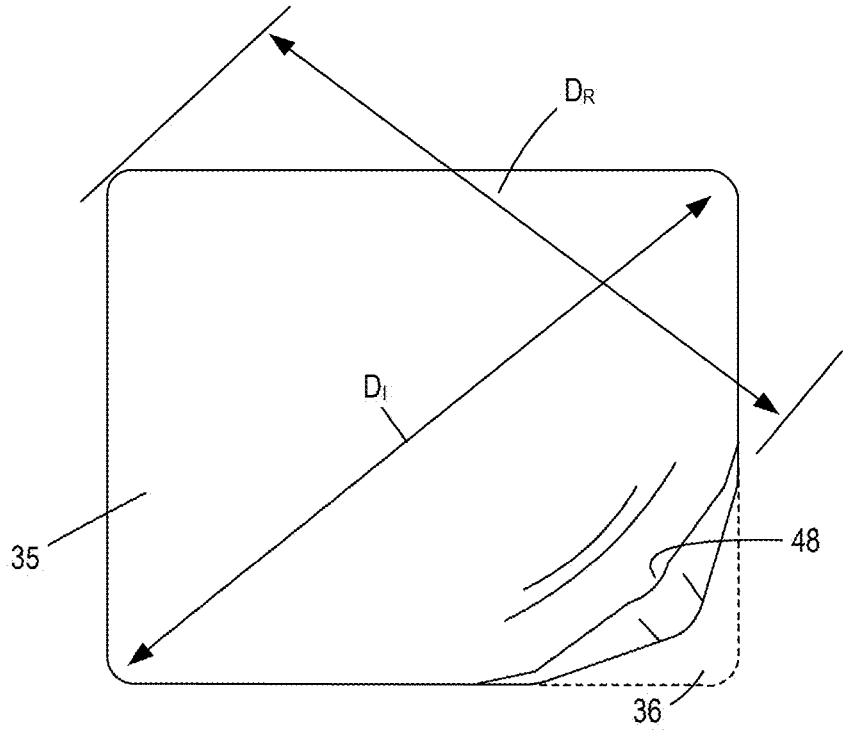
FIG. 8 is a top view of an exemplary mattress and sheet assembly.

- a foot 46 of the tool 10, which comprises wedge portion 12 and heel 17, is shown in FIG. 11, and includes the anatomy of the tool 10 to the right of the break line 45;
- break line 45 is a plane in which the edge/tip 13 of the wedge portion 12 is in line or to the left of the heel 17;
- stopping point 47 is where box spring 37 meets curved neck 15 of tool 10;
- tool 10 desirably has enough curve in the tool handle 15 area (i.e., along rear major surface 19) to allow enough swing angle for the wedge portion 12 and its supporting nose or front edge 13 to clear the break line 45 so that a desired rotational moment occurs to keep the tool 10 under the mattress 36 and locked down;
- in some embodiments, if the nose or front edge 13 is to the right of the break line 45, the tool 10 is pushed out from the mattress 36 and does not stay up on its own;
- horizontal break line 32 for tool handle 15 is shown in FIG. 11, and desirably tool handle 15 passes through horizontal break line 32 to allow for a full rotation so that tool handle 15 is near or below the horizontal break line 32 when it is in a locked state;
- FIG. 11 shows fitted sheet 35 being applied over a corner of mattress 36 with corner 48 of the fitted sheet 35 to be pulled over the corner of the mattress 36 once the corner of the mattress 36 is up and locked;
- sitting point 49 shown in FIG. 11 is where nose or front edge 13 meets mattress 36, and desirably, at this point, mattress 36 can envelope the nose or front edge 13 and keep the tool 10 in place securely;
- FIG. 8 shows mattress 36 with fitted sheet 35 being installed thereon, with distance $D_I$ showing the distance that fitted sheet 35 extends once positioned using tool 10, and distance $D_R$ represents a length of a partially installed fitted sheet 35 in a relaxed state during normal installation circumstances
- FIGS. 13-14 show a quick corner flip sheet installation, wherein pulling moment 50 is used to flip a corner 48 of the fitted sheet 35 over the corner 51 of the mattress 36 (as shown in FIG. 13), with sheet material take-up 58 represent sheet material 35 that tool 10 will position past a pinch point 59;

pinch point 59 is the "hinge" or "pinch" point at which the nose or front edge 13 of tool 13 will pivot into the mattress 36 (i.e., along corner 51 of mattress 36); and the elastic portion of fitted sheet 35 will snap and spring over the heel 17 of the tool 10 and be diverted to the lowest point on the corner 48 that the sheet material take-up 58 will allow, which is referred to herein as "shooting the corner," namely, the tension in the elastic will slide off the heel 17 and spring down the side of the mattress 36.

Additional Embodiments

Bedmaking Tools

1. A bedmaking tool 10 comprising: a tool body 11 having an overall height $H_o$, an overall width $W_o$, an overall thickness $T_o$, and an overall length $L_o$, said tool body 11 comprising (a) a wedge portion 12 comprising a tool front edge 13 (or nose 13) at a first end 14, (b) a tool handle 15 (or cantilever arm 15) at a second end 16 opposite said first end 14, (c) a heel 17 positioned between said wedge portion 12 and said tool handle 15, said heel 17 comprising a heel surface portion 18 having an arc of curvature thereon, and representing a portion of a rear major surface 19 of said bedmaking tool 10, (d) a front major surface 20 extending from said tool front edge 13 towards said second end 16, (e) a bottom surface 21 extending from said tool front edge 12 to said heel surface portion 18, and (f) said rear major surface 19 extending from said heel surface portion 18 towards the second end 16, wherein (1) said overall length $L_o$ comprises a distance from said first end 14 to said second end 16 along said bottom surface 21 and said rear major surface 19, and (2)(i) a first portion 20' of said front major surface 20 forms a first acute angle A with said bottom surface 21 along said wedge portion 12 of said tool body 11, and (ii) a second portion 20" of said front major surface 20 forms a second acute angle B with said bottom surface 21 along said tool handle 15 of said tool body 11. See, for example, FIG. 3.

Figure 4:
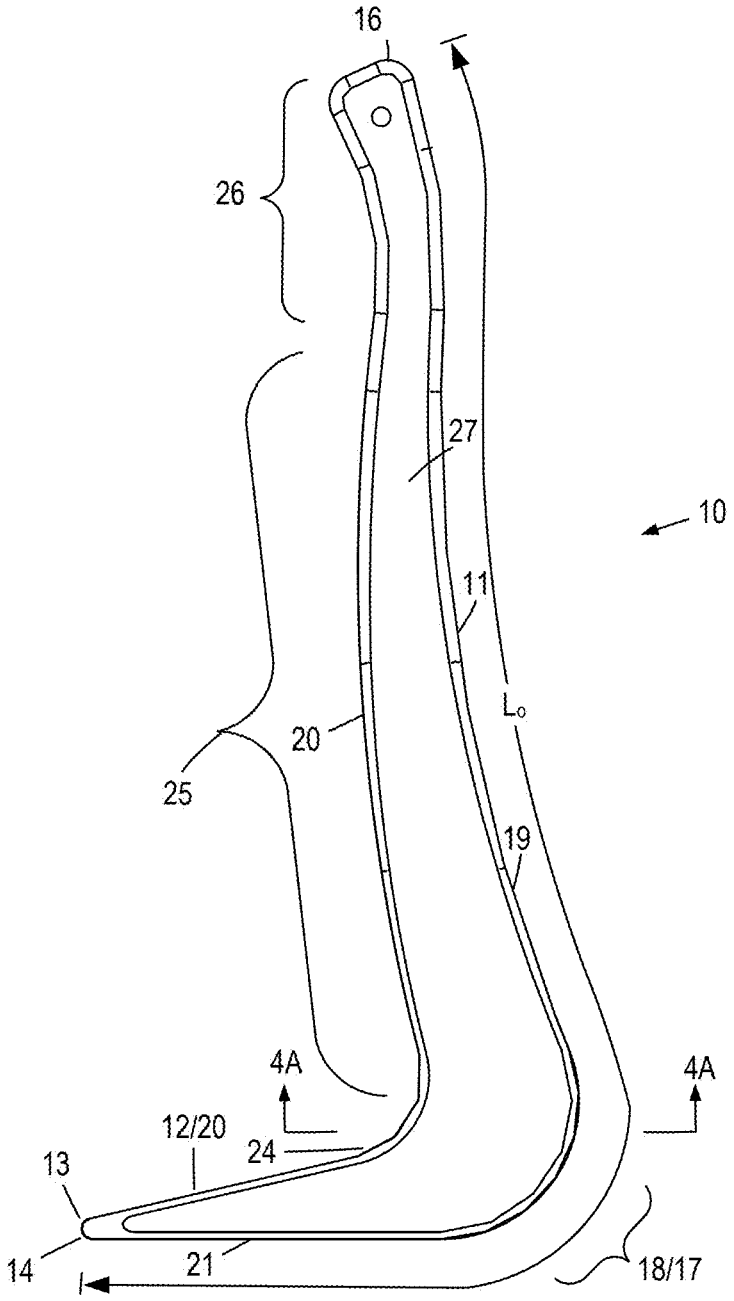
FIG. 4 is a right-side view of the exemplary bed-making tool shown in FIG. 1.
Figure 4A:
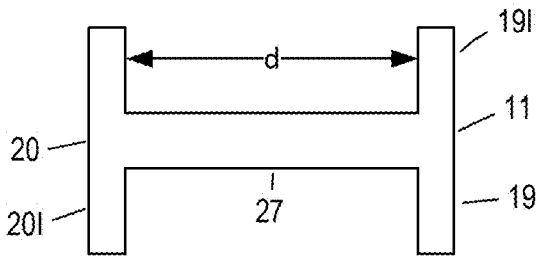
FIG. 4A is a cross-sectional view of the exemplary bed-making tool along view 4A-4A shown in FIG. 4.

2. A bedmaking tool 10 comprising: a tool body 11 having an overall height $H_o$, an overall width $W_o$, an overall thickness $T_o$, and an overall length $L_o$, said tool body 11 comprising (a) a wedge portion 12 comprising a tool front edge 13 (or nose 13) at a first end 14, (b) a tool handle 15 (or cantilever arm 15) at a second end 16 opposite said first end 14, (c) a heel 17 positioned between said wedge portion 12 and said tool handle 15, said heel 17 comprising a heel surface portion 18 having an arc of curvature thereon, and representing a portion of a rear major surface 19 of said bedmaking tool 10, (d) a front major surface 20 extending from said tool front edge 13 towards said second end 16, (e) a bottom surface 21 extending from said tool front edge 12 to said heel surface portion 18, and (f) said rear major surface 19 extending from said heel surface portion 18 towards the second end 16, wherein (1) said overall length $L_o$ comprises a distance from said first end 14 to said second end 16 along said bottom surface 21 and said rear major surface 19, and (2) said tool body 11 comprises an I-beam type construction comprising (a) a front I-beam member 20I providing said front major surface 20, (b) a rear I-beam member 19I providing said bottom surface 21 and said rear major surface 19, and (c) an intermediate I-beam connecting member 27 extending between said front I-beam member 20I and said rear I-beam member 19I, said front I-beam member 20I being a distance d from said rear I-beam member 19I along said overall length $L_o$ of said tool body 11. See, for example, FIGS. 4-4A.

3. A bedmaking tool 10 comprising: a tool body 11 having an overall height $H_o$, an overall width $W_o$, an overall thickness $T_o$, and an overall length $L_o$, said tool body 11 comprising (a) a wedge portion 12 comprising a tool front edge 13 (or nose 13) at a first end 14, (b) a tool handle 15 (or cantilever arm 15) at a second end 16 opposite said first end 14, (c) a heel 17 positioned between said wedge portion 12 and said tool handle 15, said heel 17 comprising a heel surface portion 18 having an arc of curvature thereon, and representing a portion of a rear major surface 19 of said bedmaking tool 10, (d) a front major surface 20 extending from said tool front edge 13 towards said second end 16, (e) a bottom surface 21 extending from said tool front edge 12 to said heel surface portion 18, and (f) said rear major surface 19 extending from said heel surface portion 18 towards the second end 16, wherein (1) said overall length $L_o$ comprises a distance from said first end 14 to said second end 16 along said bottom surface 21 and said rear major surface 19, and (2) said front major surface 16 comprises (i) a substantially flat portion 20' extending from said tool front edge 12, (ii) a first concave curvature portion 24 extending from said substantially flat portion 20' towards said second end 15, and (iii) a first convex curvature portion 25 extending between said first concave curvature portion 24 and said second end 15. See, for example, FIG. 6.

4. A bedmaking tool 10 comprising: a tool body 11 having an overall height $H_o$, an overall width $W_o$, an overall thickness $T_o$, and an overall length $L_o$, said tool body 11 comprising (a) a wedge portion 12 comprising a tool front edge 13 (or nose 13) at a first end 14, (b) a tool handle 15 (or cantilever arm 15) at a second end 16 opposite said first end 14, (c) a heel 17 positioned between said wedge portion 12 and said tool handle 15, said heel 17 comprising a heel surface portion 18 having an arc of curvature thereon, and representing a portion of a rear major surface 19 of said bedmaking tool 10, (d) a front major surface 20 extending from said tool front edge 13 towards said second end 16, (e) a bottom surface 21 extending from said tool front edge 12 to said heel surface portion 18, and (f) said rear major surface 19 extending from said heel surface portion 18 towards the second end 16, wherein (1) said overall length $L_o$ comprises a distance from said first end 14 to said second end 16 along said bottom surface 21 and said rear major surface 19, and (2) said front major surface 16 comprises (i) a substantially flat portion 20' extending from said tool front edge 12, (ii) a first concave curvature portion 24 extending from said substantially flat portion 20' towards said second end 15, (iii) a first convex curvature portion 25 extending between said first concave curvature portion 24 and said second end 15, and (iv) a second concave curvature portion 26 extending between said first convex curvature portion 25 and said second end 15. See, for example, FIG. 4.

5. The bedmaking tool 10 of any one of embodiments 2 to 4, wherein (i) a first portion 20' of said front major surface 20 forms a first acute angle A with said bottom surface 21 along said wedge portion 12 of said tool body 11, and (ii) a second portion 20" of said front major surface 20 forms a second acute angle B with said bottom surface 21 along said tool handle 15 of said tool body 11.

6. The bedmaking tool 10 of any one of embodiments 1 and 3 to 4, wherein said tool body 11 comprises an I-beam type construction comprising (a) a front I-beam member 20I providing said front major surface 20, (b) a rear I-beam member 19I providing said bottom surface 21 and said rear major surface 19, and (c) an intermediate I-beam connecting member 27 extending between said front I-beam member 20I and said rear I-beam member 19I, said front I-beam member 20I being a distanced from said rear I-beam member 19I along said overall length $L_o$ of said tool body 11.

7. The bedmaking tool 10 of any one of embodiments 1 to 2 and 5 to 6, wherein said front major surface 16 comprises (i) a substantially flat portion 20' extending from said tool front edge 12, (ii) a first concave curvature portion 24 extending from said substantially flat portion 20' towards said second end 15, and (iii) a first convex curvature portion 25 extending between said first concave curvature portion 24 and said second end 15. See, for example, FIG. 6.

8. The bedmaking tool 10 of any one of embodiments 1 to 2 and 5 to 7, wherein said front major surface 16 comprises (i) a substantially flat portion 20' extending from said tool front edge 12, (ii) a first concave curvature portion 24 extending from said substantially flat portion 20' towards said second end 15, (iii) a first convex curvature portion 25 extending between said first concave curvature portion 24 and said second end 15, and (iv) a second concave curvature portion 26 extending between said first convex curvature portion 25 and said second end 15. See, for example, FIG. 4.

9. The bedmaking tool 10 of any one of embodiments 1 and 5 to 8, wherein first acute angle A is less than about 45°, and second acute angle B is greater than about 45° up to about 90°.

10. The bedmaking tool 10 of any one of embodiments 1 and 5 to 9, wherein first acute angle A is from about 10° to about 30°, and second acute angle B is from about 60° to about 90°.

11. The bedmaking tool 10 of any one of embodiments 1 and 5 to 10, wherein first acute angle A is about 15°, and second acute angle B is about 80°.

12. The bedmaking tool 10 of any one of embodiments 1 to 11, wherein a third portion 20''' of said front major surface 20 forms a first obtuse angle C with said bottom surface 21 along said tool handle 15 of said tool body 11. See, for example, FIG. 3.

13. The bedmaking tool 10 of embodiment 12, wherein said first obtuse angle C ranges from greater than about 90° to about 120°.

14. The bedmaking tool 10 of embodiment 12 or 13, wherein said first obtuse angle C ranges from about 95° to about 110°.

15. The bedmaking tool 10 of any one of embodiments 12 to 14, wherein said first obtuse angle C is about 100°.

16. The bedmaking tool 10 of any one of embodiments 1 to 15, wherein a fourth portion 20''' of said front major surface 20 forms a second acute angle D with said bottom surface 21 along said tool handle 15 of said tool body 11. See, for example, FIG. 3.

17. The bedmaking tool 10 of embodiment 16, wherein said second acute angle D ranges from greater than about 45° to less than about 90°.

18. The bedmaking tool 10 of embodiment 16 or 17, wherein said second acute angle D ranges from about 55° to about 80°.

19. The bedmaking tool 10 of any one of embodiments 16 to 18, wherein said second acute angle D is about 60°.

20. The bedmaking tool 10 of any one of embodiments 1 to 19, wherein said tool body 11 comprises a solid construction with negligible or no voids within said tool body 11.

21. The bedmaking tool 10 of any one of embodiments 1 to 19, wherein said tool body 11 comprises at least one void or hollow portion within said tool body 11.

22. The bedmaking tool 10 of any one of embodiments 2 and 6 to 21, wherein said distance d varies from about 0 at said tool front edge 13 (or nose 13) up to about 3.0 inches (in) along said overall length $L_o$ of said tool body 11. It should be noted that distance d can be any length greater than 0 up to 3.0 in, in increments of 0.1 in, e.g., about 2.2 in, or any range of values between 0 and 3.0 in, in increments of 0.1 in, e.g., from about 0.1 in to about 2.8 in.

23. The bedmaking tool 10 of any one of embodiments 2 and 6 to 22, wherein said distance d varies from about 0 at said tool front edge 13 (or nose 13) up to about 2.0 in along said overall length $L_o$ of said tool body 11.

24. The bedmaking tool 10 of any one of embodiments 1 to 23, wherein said overall height $H_o$ ranges from about 6.0 in to about 48.0 in, said overall width $W_o$ ranges from about 1.0 in to about 6.0 in, said overall thickness $T_o$ ranges from about 0.2 in to about 4.0 in, and said overall length $L_o$ ranges from about 9.0 in to about 60.0 in.

25. The bedmaking tool 10 of any one of embodiments 1 to 24, wherein said overall height $H_o$ ranges from about 12.0 in to about 30.0 in, said overall width $W_o$ ranges from about 1.5 in to about 4.0 in, said overall thickness $T_o$ ranges from about 0.3 in to about 3.5 in, and said overall length $L_o$ ranges from about 18.0 in to about 45.0 in.

26. The bedmaking tool 10 of any one of embodiments 1 to 25, wherein said overall height $H_o$ is about 24.0 in, said overall width $W_o$ ranges from about 1.5 in to about 3.0 in, said overall thickness $T_o$ ranges from about 0.3 in to about 3.2 in, and said overall length $L_o$ is about 21.0 in.

27. The bedmaking tool 10 of any one of embodiments 1 to 26, wherein said overall width $W_o$ remains substantially constant along said tool body 11.

28. The bedmaking tool 10 of any one of embodiments 1 to 26, wherein said overall width $W_o$ varies along said tool body 11.

29. The bedmaking tool 10 of any one of embodiments 1 to 26 and 28, wherein said overall width $W_o$ (i) remains substantially constant along said wedge portion 12 and said heel 17, and (ii) decreases along said overall length $L_o$ from said heel 17 to said first end 14.

30. The bedmaking tool 10 of any one of embodiments 1 to 29, wherein said overall thickness $T_o$ varies along said tool body 11.

31. The bedmaking tool 10 of any one of embodiments 1 to 30, wherein said overall thickness $T_o$ is greatest along said heel 17 of said tool body 11.

32. The bedmaking tool 10 of any one of embodiments 1 to 31, wherein said overall thickness $T_o$ gradually increases along said wedge portion 12, reaches a greatest thickness along said heel 17, and decreases along at least a portion of said overall length $L_o$ from said heel 17 to said first end 14.

33. The bedmaking tool 10 of embodiment 32, wherein said overall thickness $T_o$ remains substantially constant along at least a portion of said overall length $L_o$ from said heel 17 to said first end 14.

34. The bedmaking tool 10 of any one of embodiments 1 to 33, wherein said bedmaking tool 10 stands upright on a flat surface via said bottom surface 21.

35. The bedmaking tool 10 of any one of embodiments 1 to 34, further comprising a hole 22 extending through said tool body 11 at second end 16, said hole 22 being sized to accept a cord or string (not shown) that enables said bedmaking tool 10 to be stored on a nail (or similar item)(not shown).

36. The bedmaking tool 10 of any one of embodiments 1 to 35, wherein said tool body 11 comprises one or more materials selected from a polymer, a metal, a ceramic, a cellulosic material (e.g., wood), a foam material, or any combination thereof.

37. The bedmaking tool 10 of any one of embodiments 1 to 36, wherein said tool body 11 comprises a fiber-reinforced polymer. It should be understood that any polymer may be used to form the bedmaking tool 10 as long as the resulting bedmaking tool 10 has a desired amount of stiffness, rigidity, and lifting capacity.

38. The bedmaking tool 10 of any one of embodiments 1 to 37, wherein said tool body 11 comprises polypropylene.

39. The bedmaking tool 10 of any one of embodiments 1 to 38, wherein said tool body 11 comprises fiber-reinforced polypropylene. It should be understood that any reinforcing fiber may be used including, but not limited to, glass fibers, carbon fibers, aramid fibers, etc., or any combination thereof. The fibers may be incorporated into the bedmaking tool 10 as individual fibers, unidirectional fibers, a nonwoven fabric, a woven fabric, a knit fabric, or any combination thereof.

40. The bedmaking tool 10 of any one of embodiments 1 to 37, wherein said tool body 11 comprises polyvinyl chloride (PVC).

41. The bedmaking tool 10 of any one of embodiments 1 to 37 and 40, wherein said tool body 11 comprises fiber-reinforced polyvinyl chloride (PVC).

42. The bedmaking tool 10 of any one of embodiments 1 to 36 and 38, wherein said tool body 11 consists essentially of polypropylene.

43. The bedmaking tool 10 of any one of embodiments 1 to 39, wherein said tool body 11 consists essentially of fibers and polypropylene.

44. The bedmaking tool 10 of any one of embodiments 1 to 36 and 40, wherein said tool body 11 consists essentially of polypropylene.

45. The bedmaking tool 10 of any one of embodiments 1 to 37 and 41, wherein said tool body 11 consists essentially of fibers and polypropylene.

Methods of Making Bedmaking Tools

46. A method of making the bedmaking tool 10 of any one of embodiments 1 to 45, said method comprising at least one of: a thermoforming step, a machining step, a molding step, and an extrusion step.

47. A method of making a bedmaking tool 10, said method comprising: forming a tool body 11 having an overall height $H_o$, an overall width $W_o$, an overall thickness $T_o$, and an overall length $L_o$, the tool body 11 comprising (a) a wedge portion 12 comprising a tool front edge 13 (or nose 13) at a first end 14, (b) a tool handle 15 (or cantilever arm 15) at a second end 16 opposite the first end 14, (c) a heel 17 positioned between the wedge portion 12 and the tool handle 15, the heel 17 comprising a heel surface portion 18 having an arc of curvature thereon, and representing a portion of a rear major surface 19 of the bedmaking tool 10, (d) a front major surface 20 extending from the tool front edge 13 towards the second end 16, (e) a bottom surface 21 extending from the tool front edge 12 to the heel surface portion 18, and (f) the rear major surface 19 extending from the heel surface portion 18 towards the second end 16, wherein the overall length $L_o$ comprises a distance from the first end 14 to the second end 16 along the bottom surface 21 and the rear major surface 19, said forming step comprising at least one of: a thermoforming step, a machining step, a molding step, and an extrusion step.

48. The method of embodiment 46 or 47, wherein said forming step comprises a thermoforming step or molding step.

49. The method of any one of embodiments 46 to 48, further comprising a hole-forming step, said hole-forming step being used to from a hole 22 through tool body 11 at second end 16.

50. The method of any one of embodiments 46 to 49, further comprising any additional step, if any, needed to provide one or more features as described in embodiments 1 to 45.

Methods of Using Bedmaking Tools

51. A method of using the bedmaking tool 10 of any one of embodiments 1 to 45, said method comprising at least one of: inserting a wedge portion 12 comprising a tool front edge 13 (or nose 13) at a first end 14 of the bed-making tool 10 between a mattress 36 and a box spring 37; and at least one of: positioning a sheet 35 between the mattress 36 and the box spring 37 using the wedge portion 12 of the bed-making tool 10, lifting the mattress 36 by pushing down on a tool handle 15 (or cantilever arm 15) of the bed-making tool 10, and moving the mattress 36 relative to the box spring 37 using the bed-making tool 10.

52. A method of using a bed-making tool 10 comprises: inserting a wedge portion 12 comprising a tool front edge 13 (or nose 13) at a first end 14 of the bed-making tool 10 between a mattress 36 and a box spring 37; and at least one of: positioning a sheet 35 between the mattress 36 and the box spring 37 using the wedge portion 12 of the bed-making tool 10, lifting the mattress 36 by pushing down on a tool handle 15 (or cantilever arm 15) of the bed-making tool 10, and moving the mattress 36 relative to the box spring 37 using the bed-making tool 10.

The present invention is described above and further illustrated below by way of examples, which are not to be construed in any way as imposing limitations upon the scope of the invention. On the contrary, it is to be clearly understood that resort may be had to various other embodiments, modifications, and equivalents thereof which, after reading the description herein, may suggest themselves to those skilled in the art without departing from the spirit of the present invention and/or the scope of the appended claims.

Example 1

Preparation of Bedmaking Tool

Exemplary bedmaking tools having one of more features (i) as shown in FIGS. 1-7 and/or (ii) as described in embodiments 1 to 45 above were prepared using conventional steps (e.g., one or more thermoforming steps, one or more machining steps, one or more 3D printing steps, one or more connection/assembly steps, one or more cutting steps, etc.).

Example 2

Use of a Bedmaking Tool

Bedmaking tools formed in Example 1 were used in methods of making beds and/or manipulating a sheet 35, a mattress 36, and/or a box spring 37 as shown in FIGS. 8-14.

It should be understood that although the above-described bedmaking tools, and/or methods are described as "comprising" one or more components or steps, the above-described bedmaking tools, and/or methods may "comprise," "consists of," or "consist essentially of" any of the above-described components, features, or steps of the bedmaking tools, and/or methods. Consequently, where the present invention, or a portion thereof, has been described with an open-ended term such as "comprising," it should be readily understood that (unless otherwise stated) the description of the present invention, or the portion thereof, should also be interpreted to describe the present invention, or a portion thereof, using the terms "consisting essentially of" or "consisting of" or variations thereof as discussed below.

As used herein, the terms "comprises," "comprising," "includes," "including," "has," "having," "contains," "containing," "characterized by" or any other variation thereof, are intended to encompass a non-exclusive inclusion, subject to any limitation explicitly indicated otherwise, of the recited components. For example, a bedmaking tool, and/or method that "comprises" a list of elements (e.g., components, features, or steps) is not necessarily limited to only those elements (or components or steps), but may include other elements (or components or steps) not expressly listed or inherent to the bedmaking tool, and/or method.

As used herein, the transitional phrases "consists of" and "consisting of" exclude any element, step, or component not specified. For example, "consists of" or "consisting of" used in a claim would limit the claim to the components, materials or steps specifically recited in the claim except for impurities ordinarily associated therewith (i.e., impurities within a given component). When the phrase "consists of" or "consisting of" appears in a clause of the body of a claim, rather than immediately following the preamble, the phrase "consists of" or "consisting of" limits only the elements (or components or steps) set forth in that clause; other elements (or components) are not excluded from the claim as a whole.

As used herein, the transitional phrases "consists essentially of" and "consisting essentially of" are used to define a bedmaking tool, and/or method that includes materials, steps, features, components, or elements, in addition to those literally disclosed, provided that these additional materials, steps, features, components, or elements do not materially affect the basic and novel characteristic(s) of the claimed invention. The term "consisting essentially of" occupies a middle ground between "comprising" and "consisting of."

Further, it should be understood that the herein-described bedmaking tools, and/or methods may comprise, consist essentially of, or consist of any of the herein-described components and features, as shown in the figures with or without any feature(s) not shown in the figures. In other words, in some embodiments, the bedmaking tools, and/or methods of the present invention do not have any additional features other than those shown in the figures, and such additional features, not shown in the figures, are specifically excluded from the bedmaking tools, and/or methods. In other embodiments, the bedmaking tools, and/or methods of the present invention do have one or more additional features that are not shown in the figures.

While the specification has been described in detail with respect to specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A bedmaking tool (10) comprising:

a tool body (11) having an overall height ($H_o$), an overall width ($W_o$), an overall thickness ($T_o$), and an overall length ($L_o$), said tool body (11) comprising (a) a wedge portion (12) comprising a tool front edge (13) at a first end (14), (b) a tool handle (15) at a second end (16) opposite said first end (14), (c) a heel (17) positioned between said wedge portion (12) and said tool handle (15), said heel (17) comprising a heel surface portion (18) having an arc of curvature thereon, and representing a portion of a rear major surface (19) of said bedmaking tool (10), (d) a front major surface (20) extending from said tool front edge (13) towards said second end (16), (e) a bottom surface (21) extending from said tool front edge (13) to said heel surface portion (18), and (f) said rear major surface (19) extending from said heel surface portion (18) towards the second end (16), wherein (1) said overall length ($L_o$) comprises a distance from said first end (14) to said second end (16) along said bottom surface (21) and said rear major surface (19), (2)(i) a first portion (20') of said front major surface (20) forms a first acute angle (A) with said bottom surface (21) along said wedge portion (12) of said tool body (11), and (ii) a second portion (20") of said front major surface (20) forms a second acute angle (B) with said bottom surface (21) along said tool handle (15) of said tool body (11), and (3) said tool body (11) comprises an I-beam construction comprising (a) a front I-beam member (20I) providing said front major surface (20), (b) a rear I-beam member (19I) providing said bottom surface (21) and said rear major surface (19), and (c) an intermediate I-beam connecting member (27) extending between said front I-beam member (20I) and said rear I-beam member (19I), said front I-beam member (20I) being a distance (d) from said rear I-beam member (19I) along said overall length ($L_o$) of said tool body (11).

2. The bedmaking tool (10) of claim 1, wherein said front major surface (20) comprises (i) a substantially flat portion (20') extending from said tool front edge (12), (ii) a first concave curvature portion (24) extending from said substantially flat portion (20') towards said second end (16), and (iii) a first convex curvature portion (25) extending between said first concave curvature portion (24) and said second end (16).

3. The bedmaking tool (10) of claim 1, wherein said front major surface (20) comprises (i) a substantially flat portion (20') extending from said tool front edge (12), (ii) a first concave curvature portion (24) extending from said substantially flat portion (20') towards said second end (16), and (iii) a first convex curvature portion (25) extending between said first concave curvature portion (24) and said second end (16), and (iv) a second concave curvature portion (26) extending between said first convex curvature portion (25) and said second end (16).

4. The bedmaking tool (10) of claim 1, wherein said first acute angle (A) is less than 45°, and said second acute angle (B) is greater than 45° and up to 90°.

5. The bedmaking tool (10) of claim 1, wherein said first acute angle (A) is from 10° to 30°, and said second acute angle (B) is from 60° to 90°.

6. The bedmaking tool (10) of claim 5, wherein a third portion (20''') of said front major surface (20) forms a first obtuse angle (C) with said bottom surface (21) along said tool handle (15) of said tool body (11), wherein said first obtuse angle (C) ranges from 95° to 110°.

7. The bedmaking tool (10) of claim 6, wherein a fourth portion (20'''') of said front major surface (20) forms a second acute angle (D) with said bottom surface (21) along said tool handle (15) of said tool body (11), wherein said second acute angle (D) ranges from 55° to 80°.

8. The bedmaking tool (10) of claim 1, wherein said distance (d) varies from 0 inches at said tool front edge (13) up to 3.0 inches along said overall length (Lo) of said tool body (11).

9. The bedmaking tool (10) of claim 1, wherein said overall height ($H_o$) ranges from 12.0 inches to 30.0 inches, said overall width ($W_o$) ranges from 1.5 in inches to 4.0 inches, said overall thickness ($T_o$) ranges from 0.3 inches to 3.5 inches, and said overall length ($L_o$) ranges from 18.0 inches to 45.0 inches.

10. The bedmaking tool (10) of claim 1, wherein said overall width ($W_o$) (i) remains substantially constant along said wedge portion (12) and said heel (17), and (ii) decreases along said overall length ($L_o$) from said heel (17) to said first end (14).

11. The bedmaking tool (10) of claim 10, wherein said overall thickness (To) increases along said wedge portion (12), reaches a greatest thickness along said heel (17), and decreases along at least a portion of said overall length (Lo) from said heel (17) to said first end (14).

12. The bedmaking tool (10) of claim 1, wherein said bedmaking tool (10) stands upright on a flat surface via said bottom surface (21).

13. The bedmaking tool (10) of claim 1, wherein said tool body (11) comprises polypropylene, fiber-reinforced polypropylene, polyvinyl chloride (PVC), or fiber-reinforced polyvinyl chloride (PVC).

14. A bedmaking tool (10) comprising:

a tool body (11) having an overall height ($H_o$), an overall width ($W_o$), an overall thickness ($T_o$), and an overall length ($L_o$), said tool body (11) comprising (a) a wedge portion (12) comprising a tool front edge (13) at a first end (14), (b) a tool handle (15) at a second end (16) opposite said first end (14), (c) a heel (17) positioned between said wedge portion (12) and said tool handle (15), said heel (17) comprising a heel surface portion (18) having an arc of curvature thereon, and representing a portion of a rear major surface (19) of said bedmaking tool (10), (d) a front major surface (20) extending from said tool front edge (13) towards said second end (16), (e) a bottom surface (21) extending from said tool front edge (13) to said heel surface portion (18), and (f) said rear major surface (19) extending from said heel surface portion (18) towards the second end (16), wherein (1) said overall length ($L_o$) comprises a distance from said first end (14) to said second end (16) along said bottom surface (21) and said rear major surface (19), (2)(i) a first portion (20') of said front major surface (20) forms a first acute angle (A) with said bottom surface (21) along said wedge portion (12) of said tool body (11), and (ii) a second portion (20") of said front major surface (20) forms a second acute angle (B) with said bottom surface (21) along said tool handle (15) of said tool body (11), (3) said tool body (11) comprises an I-beam type construction comprising (a) a front I-beam member (20I) providing said front major surface (20), (b) a rear I-beam member (19I) providing said bottom surface (21) and said rear major surface (19), and (c) an intermediate I-beam connecting member (27) extending between said front I-beam member (20I) and said rear I-beam member (19I), said front I-beam member (20I) being a distance (d) from said rear I-beam member (19I) along said overall length ($L_o$) of said tool body (11), and (4) said overall height ($H_o$) ranges from 12.0 inches to 30.0 inches, said overall width ($W_o$) ranges from 1.5 inches to 4.0 inches, said overall thickness ($T_o$) ranges from 0.3 inches to 3.5 inches, and said overall length ($L_o$) ranges from 18.0 inches to 45.0 inches.

15. The bedmaking tool (10) of claim 14, wherein said tool body (11) comprises polypropylene, fiber-reinforced polypropylene, polyvinyl chloride (PVC), or fiber-reinforced polyvinyl chloride (PVC).

16. A bedmaking tool (10) comprising:

a tool body (11) having an overall height ($H_o$), an overall width ($W_o$), an overall thickness ($T_o$), and an overall length ($L_o$), said tool body (11) comprising (a) a wedge portion (12) comprising a tool front edge (13) at a first end (14), (b) a tool handle (15) at a second end (16) opposite said first end (14), (c) a heel (17) positioned between said wedge portion (12) and said tool handle (15), said heel (17) comprising a heel surface portion (18) having an arc of curvature thereon, and representing a portion of a rear major surface (19) of said bedmaking tool (10), (d) a front major surface (20) extending from said tool front edge (13) towards said second end (16), (e) a bottom surface (21) extending from said tool front edge (13) to said heel surface portion (18), and (f) said rear major surface (19) extending from said heel surface portion (18) towards the second end (16), wherein (1) said overall length ($L_o$) comprises a distance from said first end (14) to said second end (16) along said bottom surface (21) and said rear major surface (19), (2)(i) a first portion (20') of said front major surface (20) forms a first acute angle (A) with said bottom surface (21) along said wedge portion (12) of said tool body (11), and (ii) a second portion (20") of said front major surface (20) forms a second acute angle (B) with said bottom surface (21) along said tool handle (15) of said tool body (11), (3) said tool body (11) comprises an I-beam type construction comprising (a) a front I-beam member (20I) providing said front major surface (20), (b) a rear I-beam member (19I) providing said bottom surface (21) and said rear major surface (19), and (c) an intermediate I-beam connecting member (27) extending between said front I-beam member (20I) and said rear I-beam member (19I), said front I-beam member (20I) being a distance (d) from said rear I-beam member (19I) along said overall length ($L_o$) of said tool body (11), (4) said overall height ($H_o$) ranges from 12.0 inches to 30.0 inches, said overall width ($W_o$) ranges from 1.5 inches to 4.0 inches, said overall thickness ($T_o$) ranges from 0.3 inches to 3.5 inches, and said overall length ($L_o$) ranges from 18.0 inches to 45.0 inches, and (5) said first acute angle (A) is from 10° to 30°, and second acute angle (B) is from 60° to 90°.

17. The bedmaking tool (10) of claim 16, wherein said tool body (11) comprises polypropylene, fiber-reinforced polypropylene, polyvinyl chloride (PVC), or fiber-reinforced polyvinyl chloride (PVC).

* * * * *